US005239239A

United States Patent [19]

Biegel et al.

[11] Patent Number: 5,239,239

[45] Date of Patent: Aug. 24, 1993

[54] SURROUNDING A PORTION OF A LAMP WITH LIGHT REGULATION APPARATUS

[75] Inventors: George E. Biegel, Framingham; John H. Rieman, Ipswich, both of Mass.

[73] Assignee: Stocker & Yale, Inc., Beverly, Mass.

[21] Appl. No.: 858,402

[22] Filed: Mar. 26, 1992

[51] Int. Cl.[5] ..... H05B 41/38

[52] U.S. Cl. ..... 315/284; 315/DIG. 4

[58] Field of Search ..... 315/41, 59, 62, 57, 315/70, 71, 284, 276, 291, DIG. 4, DIG. 5, DIG. 7

[56] References Cited

U.S. PATENT DOCUMENTS

| | | | |
|---|---|---|---|
| 2,298,904 | 10/1942 | Scott et al. | 176/124 |
| 2,458,277 | 1/1949 | Lark et al. | 315/284 |
| 2,471,222 | 5/1949 | Lorant | 336/ |
| 2,829,314 | 4/1958 | Vradenburgh | 315/200 |
| 2,878,425 | 3/1959 | Kudoh | 315/284 |
| 3,209,202 | 9/1965 | Dunigan | 315/99 |
| 3,377,508 | 4/1968 | Gomonet | 315/250 |
| 3,514,668 | 5/1970 | Johnson et al. | 315/205 |
| 3,573,544 | 4/1971 | Zonis | 315/206 |
| 3,599,037 | 8/1971 | Grase | 315/284 |
| 3,611,021 | 10/1971 | Wallace | 315/239 |
| 3,659,147 | 4/1972 | Widmayer | 315/107 |
| 3,873,910 | 3/1975 | Willis, Jr. | 323/6 |
| 3,898,516 | 8/1975 | Nakasone | 315/194 |
| 3,980,921 | 9/1976 | Izawa | 315/206 |
| 4,180,764 | 12/1979 | Morup | 315/283 |
| 4,210,846 | 6/1980 | Capewell et al. | 315/121 |
| 4,251,752 | 2/1981 | Stolz | 315/206 |
| 4,341,979 | 7/1982 | Gross | 315/62 |
| 4,349,768 | 9/1982 | Miller | 315/105 |
| 4,358,716 | 11/1982 | Cordes et al. | 315/306 |
| 4,367,434 | 1/1983 | Miller | 315/51 |

(List continued on next page.)

FOREIGN PATENT DOCUMENTS

WO91/13590 9/1991 PCT Int'l Appl. ..... 37/2

OTHER PUBLICATIONS

Storm, "*Magnetic Amplifiers*", Chapter 2, 4–7, and 21–24; pp. 29–46, 62–112, and 341–410; 1959.

Lithonia Lighting, Litronic TM and Equinox TM brochure; pp. 301 and 312; date unknown.

Advance Transformer Co., "Mark VII Controllable Integrated Circuit Ballasts", 1991.

ETTAS Industries, Inc. "Specifications for the Etta Fiberoptic Sunsensor"; 1991.

Forest M. Mims III, Radio Shack, Engineer's Mini-Notebook; "Optoelectronics Circuits"; Cat. No. 276–5012; date unknown.

Ghecrghiu et al., Tratat de Masini Electrice; "Transformatoare"; vol. AL-II-LEA; pp. 455–457; 1970.

Veinott et al., Electric Motors, "Fractional and Subfractional Horsepower", Fourth Edition; pp. 176–179; date unknown.

*Primary Examiner*—Eugene R. LaRoche
*Assistant Examiner*—A. Zarabian
*Attorney, Agent, or Firm*—Fish & Richardson

[57] ABSTRACT

A device for regulating the intensity of light emitted by a lamp includes a variable inductor configured to surround a portion of the lamp and electrical circuitry arranged to connect electrically the variable inductor to the lamp in a manner such that a variation in the inductance of the variable inductor will cause a corresponding variation in the intensity of light emitted by the lamp while the lamp is electrically connected to the variable inductor.

14 Claims, 5 Drawing Sheets

U.S. PATENT DOCUMENTS

| | | | |
|---|---|---|---|
| 4,370,600 | 1/1983 | Zansky | 315/244 |
| 4,392,086 | 7/1983 | Ide et al. | 315/174 |
| 4,443,740 | 4/1984 | Goralnik | 315/284 |
| 4,460,849 | 7/1984 | Virtanen | 315/209 |
| 4,475,064 | 10/1984 | Burgess | 315/227 |
| 4,477,748 | 10/1984 | Grubbs | 315/306 |
| 4,492,899 | 1/1985 | Martin | 315/308 |
| 4,518,895 | 5/1985 | Lehman | 315/117 |
| 4,523,129 | 6/1985 | Pitel | 315/291 |
| 4,523,131 | 6/1985 | Zansky | 315/307 |
| 4,540,917 | 9/1985 | Luchaco et al. | 315/291 |
| 4,551,699 | 11/1985 | Jong et al. | 336/135 |
| 4,559,479 | 12/1985 | Munson | 315/239 |
| 4,604,552 | 8/1986 | Alley et al. | 315/176 |
| 4,612,478 | 9/1986 | Payne | 315/176 |
| 4,645,979 | 2/1987 | Chow | 315/169 |
| 4,663,569 | 5/1987 | Alley et al. | 315/175 |
| 4,663,570 | 5/1987 | Luchaco et al. | 315/219 |
| 4,700,113 | 10/1987 | Stupp et al. | 315/224 |
| 4,712,045 | 12/1987 | Van Meurs | 315/DIG. 4 |
| 4,734,650 | 3/1988 | Alley et al. | 324/414 |
| 4,766,353 | 8/1988 | Burgess | 315/324 |
| 4,853,598 | 8/1989 | Kusko et al. | 315/101 |
| 4,876,498 | 10/1989 | Luchaco et al. | 323/300 |
| 4,894,587 | 1/1990 | Jungreis et al. | 315/200 |
| 4,926,097 | 5/1990 | Taek | 315/307 |
| 4,950,959 | 8/1990 | Beckrot et al. | 315/219 |
| 4,998,046 | 3/1991 | Lester | 315/209 |
| 5,001,386 | 3/1991 | Sullivan et al. | 315/219 |
| 5,015,922 | 5/1991 | Mühling | 315/284 |
| 5,023,518 | 6/1991 | Mans et al. | 315/219 |
| 5,041,763 | 8/1991 | Sullivan et al. | 315/176 |
| 5,059,870 | 10/1991 | Choon | 315/289 |

SURROUNDING A PORTION OF A LAMP WITH LIGHT REGULATION APPARATUS

CROSS REFERENCE TO RELATED APPLICATIONS

The present application is related to a U.S. patent application filed by George E. Biegel on the same day as the present application and commonly assigned with the present application.

BACKGROUND OF THE INVENTION

The present invention relates in general to regulating the intensity of light emitted by a lamp and more particularly concerns light dimming circuits having variable inductors.

Light dimming circuits can provide substantial energy savings by permitting a user to reduce light intensity to a desired level or by permitting automatic regulation of light intensity based on, e.g., the time of day or input from a motion detector that detects the presence of a person in a room.

Light dimming circuits for fluorescent lamps and the like are known in which light intensity is varied by adjusting the inductance of a variable inductor. Examples of such circuits are disclosed in U.S. application Ser. No. 07/484,112, filed Feb. 23, 1990, the entire disclosure of which is incorporated herein by reference. In particular, the above-mentioned U.S. application discloses a variable inductor connected in parallel with a fluorescent lamp powered by a high-frequency alternating current. Other light dimming circuits for fluorescent lamps powered at lower frequencies include a variable inductor connected in series with the lamp.

The inductance of the variable inductor disclosed in the above-mentioned U.S. application is varied by adjusting the geometry of the ferrite core around which the inductor is wrapped.

SUMMARY OF THE INVENTION

According to the invention, there is a device for regulating the intensity of light emitted by a lamp, the device including a variable inductor configured to surround a portion of the lamp and electrical circuitry arranged to connect electrically the variable inductor to the lamp in a manner such that a variation in the inductance of the variable inductor will cause a corresponding variation in the intensity of light emitted by the lamp while the lamp is electrically connected to the variable inductor.

The light regulation device preferably includes a core of magnetic material, the variable inductor being a primary inductor wrapped around at least a portion of the core of magnetic material. A secondary inductor is also wrapped around at least a portion of the core of magnetic material and is configured to surround a portion of the lamp. The core of magnetic material, the primary inductor, and the secondary inductor are configured in a manner such that when electrical current is passed through the secondary inductor and the electrical current is varied, the degree of saturation of the core of magnetic material around which the primary and secondary inductors are wrapped is varied, so that the inductance of the primary inductor in turn is varied, causing a change in the intensity of light emitted by the lamp.

The lamp is preferably a discharge lamp such as a fluorescent lamp, and the primary and secondary inductors are preferably wound on a cylindrical bobbin that fits over an end portion of the lamp. There are preferably a plurality of cores of magnetic material, configured in a substantially rectangular shape enclosing a region through which the primary and secondary inductors pass, and the cylindrical bobbin has indentations to accommodate the cores of magnetic material. In a preferred embodiment, at least a pair of slip-on terminals are configured to slip over pins of the lamp to provide a pair of electrical connections between the primary inductor and the pins, one of the slip-on terminals also providing an electrical connection between the secondary inductor and one of the pins.

Thus, the invention permits the primary and secondary inductors and the core of magnetic material to be easily attached to a lamp simply by sliding the assembly over one of the ends of the lamp and attaching the slip-on terminals to the lamp pins.

The current passing through the secondary inductor may a low D.C. or A.C. power source, and because the current passing through the secondary inductor is isolated from the relatively high voltages typically present in the circuitry to which the primary inductor is electrically connected, the current passing through the secondary inductor may be varied by a user safely and at any convenient location remote from the first electrical circuit. Thus, for example, a control device for varying the current through the secondary inductor can be wired through walls without special grounding or similar equipment.

Numerous other features, objects, and advantages of the invention will become apparent from the following detailed description when read in connection with the accompanying drawings.

DETAILED DESCRIPTION

Figure 1:
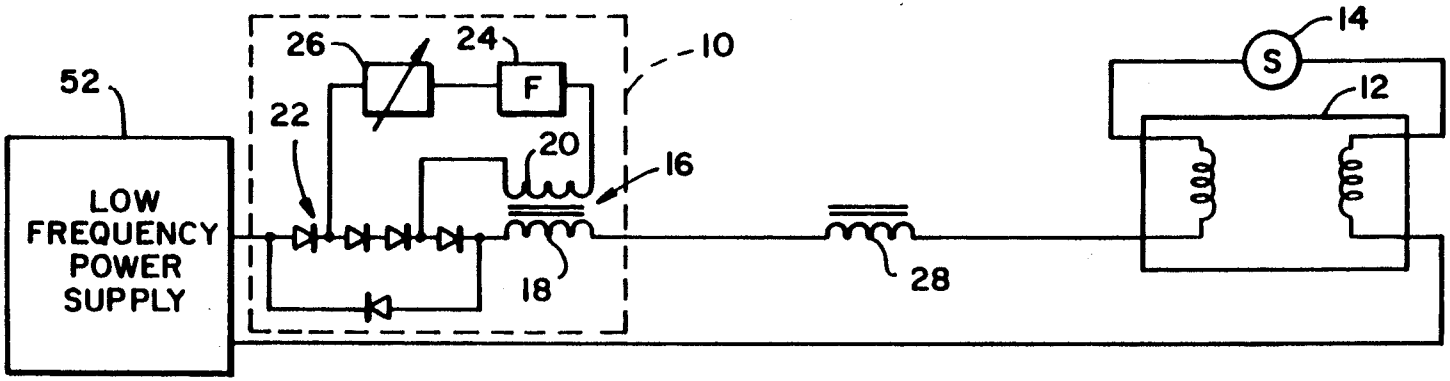
FIG. 1 shows a circuit for regulating light intensity, for use with a fluorescent lamp powered by a low-frequency alternating current.

With reference now to the drawings and more particularly FIG. 1 thereof, there is shown a device 10 for regulating the intensity of light emitted by a fluorescent lamp 12 powered by a low-frequency power supply 52 (less than 1 kilohertz) and connected to starter 14. Light regulation device 10 includes a transformer structure 16 having a core of magnetic material around which a primary inductor 18 and a secondary inductor 20 are wrapped, and it will be seen that it is possible to vary the intensity of light emitted by fluorescent lamp 12 by varying the current passing through secondary inductor 20. In particular, when the inductance of primary inductor 18 is increased, the voltage drop across fluorescent lamp 12 correspondingly decreases and consequently the intensity of light emitted by fluorescent lamp 12 decreases, and vice versa. When the current passing through secondary inductor 20 increases, the degree of saturation of the core of magnetic material increases, thereby decreasing the inductance of primary inductor 18, and vice versa. Thus, by varying the current through secondary inductor 20, it is possible to vary the intensity of light emitted by fluorescent lamp 12.

Diodes 22 are provided in one of the input A.C. power lines to permit a small D.C. voltage to be derived from the power line for use in a circuit that includes secondary inductor 20, the voltage depending upon the particular diode material and the number of diodes placed between the inner two circuit nodes. All of the elements in the circuit that includes secondary inductor 20 are isolated from the relatively high voltages present in the circuit that includes primary inductor 18. Filter 24 filters out the A.C. components of the signal passing through secondary inductor 20, the A.C. components being present because the D.C. voltage derived from diodes 22 is a half-wave rectified signal and because the A.C. current passing through primary inductor 18 induces an A.C. current in secondary inductor 20. By filtering out the A.C. components of the signal passing through secondary inductor 20, filter 24 prevents these A.C. components from inducing an undesired A.C. current in primary inductor 18 and prevents the A.C. components from damaging any of the circuit elements in the circuit that includes secondary inductor 20.

The current passing through secondary inductor 20 may alternatively be provided by a small battery such as a watch battery, or any other suitable source. For example, there may be ways to derive a voltage from a transformer on main power, a remote source such as a computer, the power supply, or the receiver shown in FIG. 4 below. It is also possible to use the voltage across the filament on one or the other side of the fluorescent lamp, either in the low-frequency embodiment of FIG. 1 or the high-frequency embodiment of FIG. 3 below. This current may be an alternating current, in which case no filter is needed if the alternating current has the same frequency as the alternating current passing through primary inductor 18. If an A.C. current is used through secondary inductor 20, a greater current is needed to vary the degree of saturation of the magnetic core than would be required if a D.C. current were used. The D.C. or A.C. voltage through secondary inductor 20 is preferably relatively low, as is the current.

Control device 26, which varies the current passing through secondary inductor 20, may be a variable impedance (either a variable resistance, a variable capacitance, or a variable inductance). A variable resistor is acceptable if the current passing through secondary inductor 20 is a D.C. current, but if the current passing through secondary inductor 20 is an A.C. current, a high-wattage resistor would be needed to accommodate the higher current, and thus a variable capacitance or a variable inductance is preferable, especially in view of the fact that a variable capacitor or inductor has very little heat loss. Examples of variable inductances that could be used are disclosed in the above-mentioned U.S. application Ser. No. 07/484,112, filed Feb. 23, 1990. Control device 26 may vary light intensity either in discrete steps or continuously, and may be, for example, a knob have a setting for turning fluorescent lamp 12 on and off, the on/off setting typically being adjacent the setting for full intensity.

Because light regulation device 10 is not incorporated into a power supply or inverter circuit, light regulation device 10 may be retro-fitted to an existing fluorescent lamp circuit having a pre-existing power supply 52, which may incorporate a pre-existing electronic ballast. The fluorescent lamp circuit may also include a pre-existing inductive choke ballast 28, primary inductor 18 being placed in series with inductive choke ballast 28. There are typically spaces available in fluorescent lamp fixtures into which transformer structure 16 may be inserted. When primary inductor 18 is placed in series with inductive choke ballast 28 and the current passing through secondary inductor 20 is sufficient to saturate completely the magnetic core, the effect is almost the same as removing the core of magnetic material entirely; i.e., the inductance of primary inductor 18 is negligible as compared with pre-existing inductive choke ballast 28 and lamp 12 is consequently at full intensity. As the current passing through secondary inductor 20 is reduced, however, the inductance of primary inductor 18 increases, thereby reducing the intensity of light emitted by lamp 12.

Figure 2:
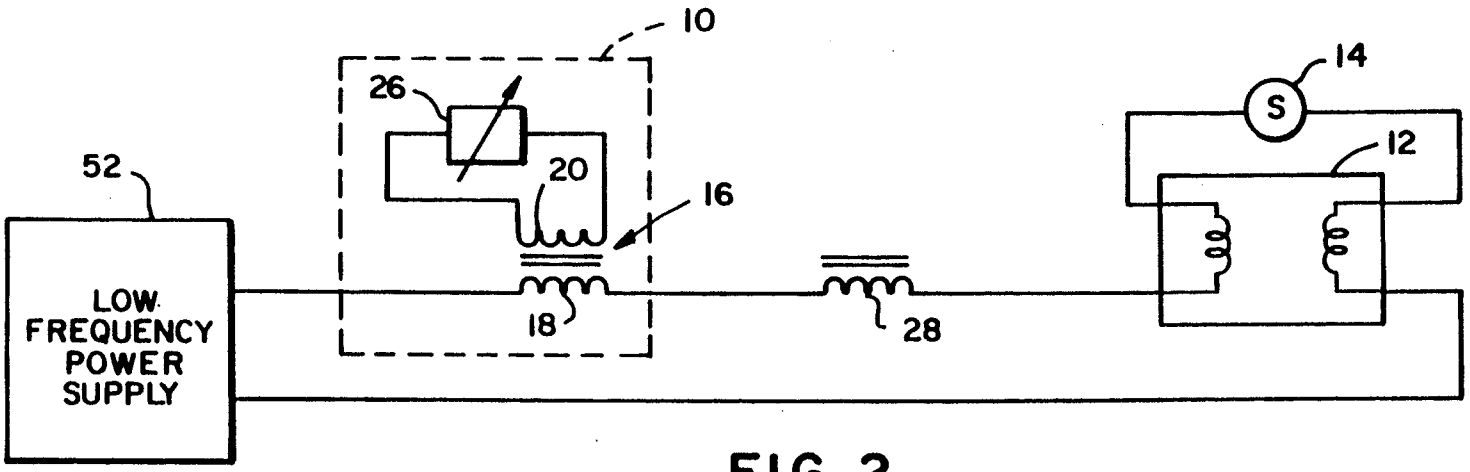
FIG. 2 shows a similar circuit in which the current passing through the secondary inductor is induced in the secondary inductor by current passing through the primary inductor.

With reference now to FIG. 2, there is shown a circuit similar to the one shown in FIG. 1 except that, instead of using diodes in one of the input A.C. power lines to derive a small D.C. voltage for use in the circuit that includes secondary inductor 20, the circuit of FIG. 2 simply utilizes the current induced in secondary inductor 20 by the current passing through primary inductor 18.

Figure 2A:
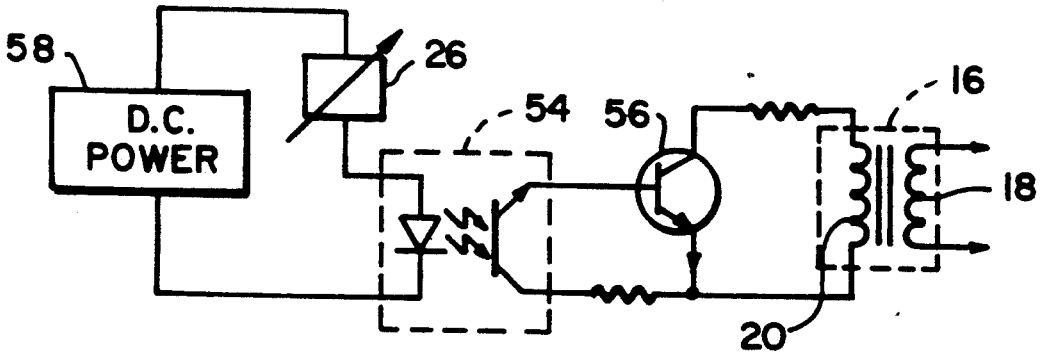
FIG. 2A shows an alternate circuit design for the light regulation device forming part of the circuit of FIG. 2.

Referring to FIG. 2A, there is shown an alternate circuit design for the light regulation device 10 shown in FIG. 2, which permits a very low D.C. current to be used to control the higher induced A.C. current passing through the secondary inductor. A low D.C. voltage of 1.5 to 10 volts, from D.C. power source 58, is applied across control device 26 and the light emitting diode portion of opto-isolator 54, and control device 26 controls the amount of current passing through the light emitting diode portion of opto-isolator 54 (the current being less than about 50 milliamps). The light emitted by the diode has an intensity that varies with the amount of current passing through the diode. This light proportionally controls the amount of current that flows through the transistor portion of opto-isolator 54, and this relatively low current controls power transistor 56, thereby varying the amount of A.C. current passing through secondary inductor 20. The power transistor is used between opto-isolator 54 and secondary inductor 20 because the opto-isolator alone would not be able to handle the amount of A.C. current passing through secondary inductor 20. The isolation between the low D.C. current and the higher A.C. current through secondary inductor 20 provided by opto-isolator 54 and power transistor 56 ensures the safety of control device 26 as it is manipulated by a user and permits control device 26 to be easily located at a remote location (e.g., wired through a wall without special grounding).

Figure 3:
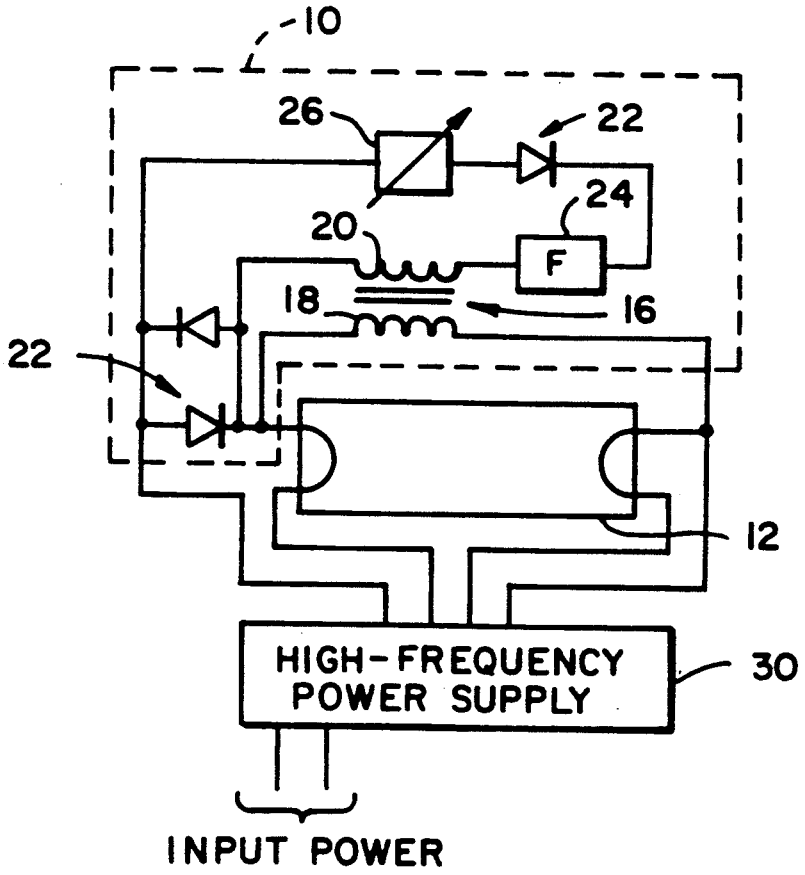
FIG. 3 shows a circuit for regulating light intensity, for use with a fluorescent lamp powered by a high-frequency alternating current.

FIG. 3 shows a circuit, analogous to the one shown in FIG. 1, for regulating the intensity of light emitted by a fluorescent lamp 12 powered by a high-frequency power supply 30 rather than a low-frequency power supply. High-frequency power supply 30, which may include an electronic ballast, operates at a frequency greater than 1 kilohertz. Primary inductor 18 is placed in parallel with fluorescent lamp 12 rather than in series, much the same as the circuit disclosed in the above-mentioned U.S. application Ser. No. 07/484,112, filed Feb. 23, 1990, in which a variable inductor is placed in parallel with a fluorescent lamp rather than in series in order to ensure stability of the light output (i.e., in order to prevent the arc inside the lamp from going off when it should be arcing) as the intensity of the light output is varied. When the inductance of primary inductor 18 is increased, the voltage drop across fluorescent lamp 12 correspondingly increases and consequently the intensity of light emitted by fluorescent lamp 12 increases, and vice versa. In this high-frequency configuration power consumption is reduced nearly proportionally to the amount of reduction in light output without any corresponding reduction in lamp life. No starter is needed at high frequency because it is much easier to ionize at these frequencies.

Figure 4:
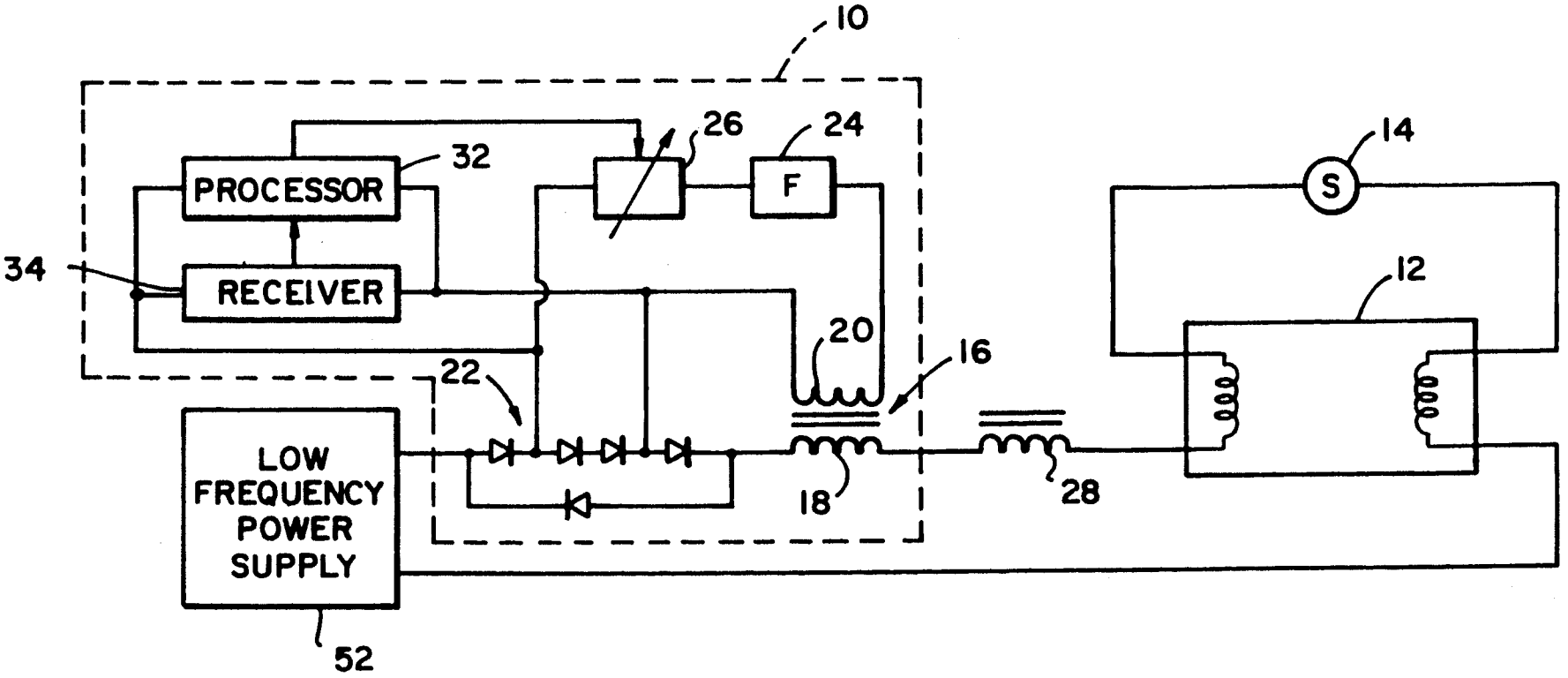
FIG. 4 shows a circuit for regulating light intensity that includes a receiver arranged to detect control signals transmitted from a remote location.

With reference now to FIG. 4, there is shown a circuit for regulating the intensity of light emitted by a lamp 12 powered by a low-frequency power supply 52 (less than 1 kilohertz), in which control device 26 is responsive to input from a processor 32 which in turn receives an input from a receiver 34 arranged to detect control signals transmitted from a remote location. The control signals may be electromagnetic signals (e.g., ultraviolet, infrared, visible light), sonic signals, or even electrical signals transmitted on an electric power line. Thus, for example, an auxiliary channel on a television or VCR remote controller can be dedicated to control of light intensity, so that the VCR remote controller is sued in conjunction with both receiver 34 and the receiver present in the television or VCR system, both receivers including opto-couplers that are responsive to electromagnetic signals and operate in a manner similar to transistors. Similarly, receiver 34 may be responsive to a radio transmitter for a garage door in order to vary light intensity when commands for opening or closing the door are given. Likewise, receiver 34 may be responsive to the amount of ambient light in an outdoor location, for the purpose of night turn-on of flood lights, or may operate as a motion detector to determine whether a room is occupied. Receiver 34 could also be responsive to activation transmitters associated with such items as cordless phones, incandescent dimmers, burglar alarms, emergency exit lights, etc. Power for processor 32 and receiver 34 may be provided by the D.C. voltage derived from one of the input A.C. lines by diodes 22. Processor 32 may be in certain embodiments a personal computer. It is relatively easy to use a computer to control the current passing through secondary inductor 20 because of the low voltage in the circuit in which secondary inductor 20 is located.

Figure 5:
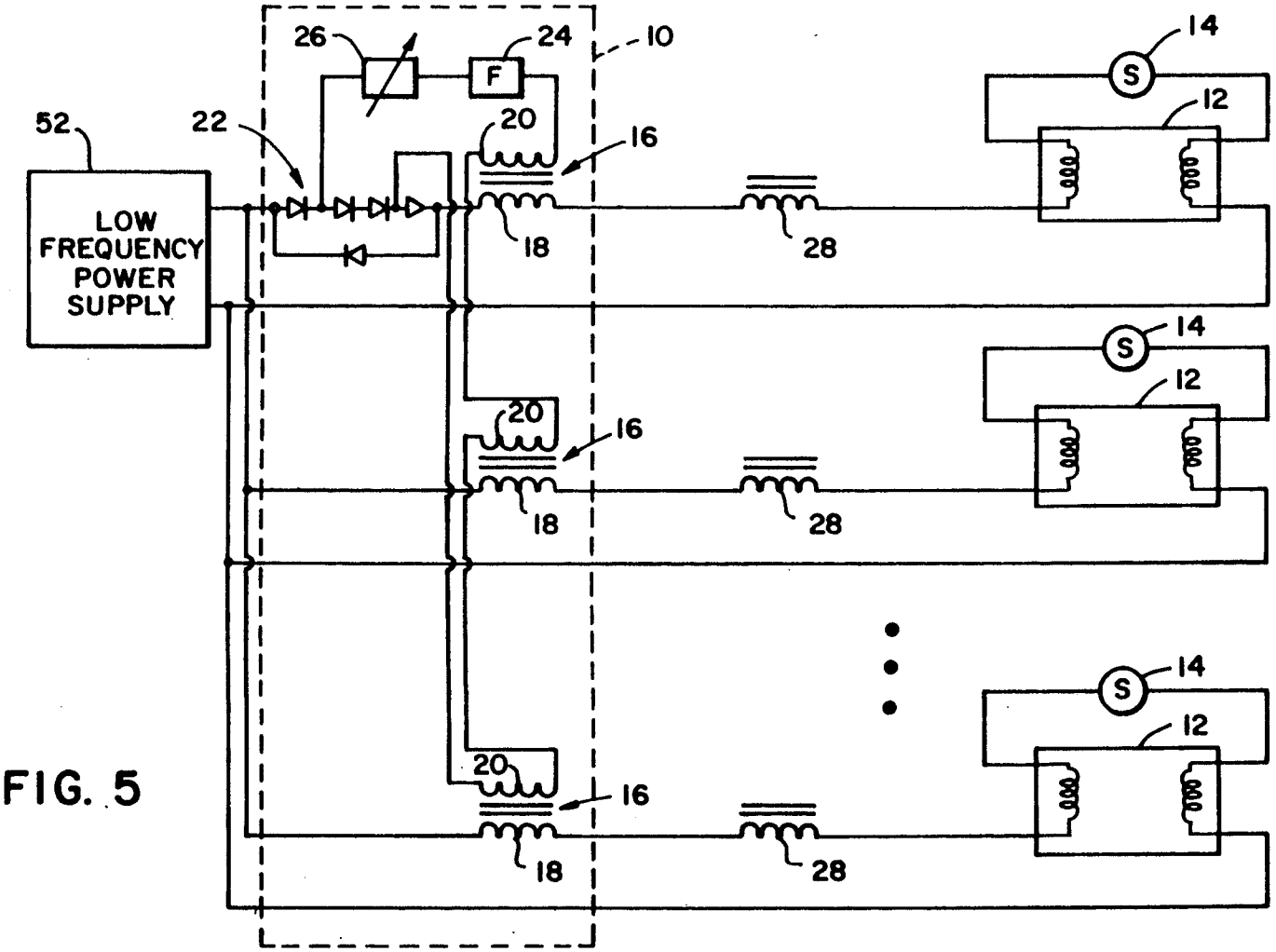
FIG. 5 shows a circuit for regulating the light intensity of a plurality of lamps.

FIG. 5 how a circuit similar to the one shown in FIG. 1 can be used to regulate simultaneously the light intensity of a plurality of fluorescent lamps 12. A single control device 26 is connected to a plurality of secondary inductors 20 to vary simultaneously the electrical current passing through each of the secondary inductors. Secondary inductors 20 are preferably connected in series as shown in FIG. 5, but may also be connected in parallel. Each secondary inductor 20 is associated with a corresponding primary inductor 18, which is in turn associated with a corresponding fluorescent lamp 12. All of the circuit elements are the same as the those that would be used with a single lamp. Thus, this configuration permits a plurality of lamps to be dimmed simultaneously, without connecting all of the lamps to a single variable inductor specially selected to have a range of inductance appropriate to the number of lamps to which it is connected. In addition, each of transformer structures 16 may be retro-fitted to existing fluorescent lamp circuits connected to a pre-existing power supply 52 and possibly including pre-existing inductive choke ballasts 28.

Figure 6:
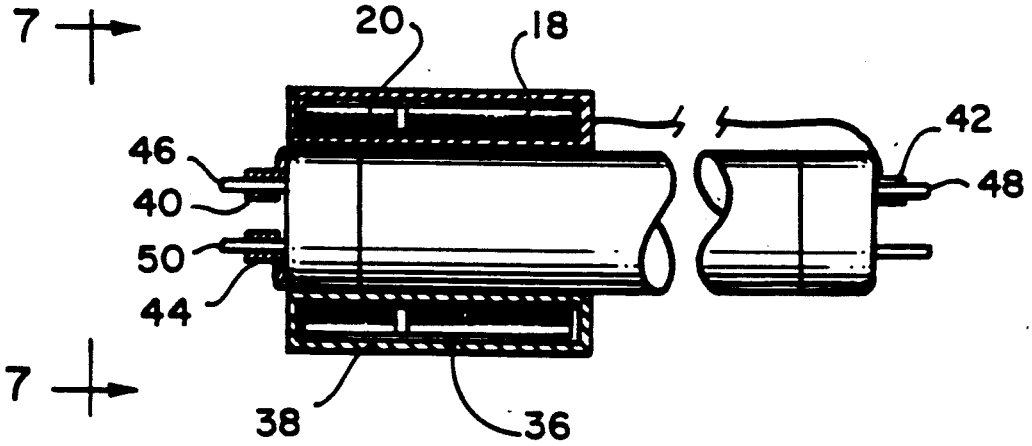
FIG. 6 shows an assembly, including primary and secondary windings and magnetic core pieces, that is slidably attached to the end of a fluorescent lamp.
Figure 7:
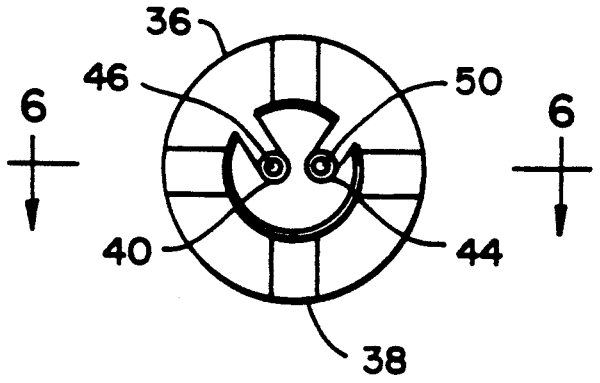
FIG. 7 is an end view of the assembly shown in FIG. 6, taken along line 7—7.

With reference now to FIGS. 6 and 7, in one embodiment of the invention, which utilizes the circuit design shown in FIG. 3, primary inductor 18 and secondary inductor 20 are would around a cylindrical bobbin 36 constructed to fit over the end of fluorescent lamp 12 as a slide-on socket. There are four cores 38 of magnetic material (although more or fewer cores may be used, depending on the construction and composition of the cores), which are rectangular in shape and enclose a region through which the primary and secondary inductors pass and fit within indentations in bobbin 36. Bobbin 36 entirely covers and insulates primary inductor 18 and secondary inductor 20.

Slip-on terminals 40, 42, and 44 are configured to slip over pins 46, 48, and 50 of the lamp respectively, with slip-on terminals 40 and 42 providing a pair of electrical connections between primary inductor 18 and pins 46 and 48, and slip-on terminal 40 additionally providing an electrical connection between secondary inductor 20 and pin 46. The actual electrical connections are not shown in FIG. 6, but can be understood from the circuit diagram shown in FIG. 3. Slip-on terminal 44 is present for structural symmetry but provides no electrical connection.

A package consisting of diodes 22, control device 26, and filter 24 (all shown in FIG. 3) is located in a remote location and is electrically connected somewhere between high-frequency power supply 30 and lamp pin 46. An electrical connection is provided between this package and secondary inductor 20. This electrical connection is not shown in FIG. 6, but appears as the electrical connection between filter 24 and secondary inductor 20 in FIG. 3.

It can be seen that the entire assembly shown in FIGS. 6 and 7 is easily attachable to fluorescent lamp 12 by sliding the assembly over one of the ends of lamp 12 and attaching the slip-on terminals to the lamp pins.

There has been described novel and improved apparatus and techniques for regulating the intensity of light emitted by a lamp. It is evident that those skilled in the art may now make numerous uses and modifications of and departures from the specific embodiment described herein without departing from the inventive concept. Consequently, the invention is to be construed as embracing each and every novel feature and novel combination of features present in or possessed by the apparatus and technique herein disclosed and limited solely by the spirit and scope of the appended claims.

What is claimed is:

1. A device for regulating the intensity of light emitted by a lamp, comprising:

an assembly comprising a variable inductor, said assembly being shaped and sized to fit over a portion of said lamp as a socket, and electrical circuitry arranged to connect electrically said variable inductor to said lamp in a manner such that a variation in the inductance of said variable inductor will cause a corresponding variation in the intensity of light emitted by said lamp while said lamp is electrically connected to said variable inductor.

2. A light regulation device in accordance with claim 1, wherein:

said light regulation device further comprises a core of magnetic material, said variable inductor is a primary inductor wrapped around at least a portion of said core of magnetic material, said light regulation device further comprises a secondary inductor wrapped around at least a portion of said core of magnetic material and configured to surround a portion of said lamp, and said core of magnetic material, said primary inductor, and said secondary inductor are configured in a manner such that when electrical current is passed through said secondary inductor and said electrical current is varied, the degree of saturation of said core of magnetic material around which said primary and secondary inductors are wrapped is varied, so that the inductance of said primary inductor in turn is varied, causing a change in the intensity of light emitted by said lamp.

3. A device for regulating the intensity of light emitted by a lamp, comprising:

a core of magnetic material, a primary inductor wrapped around at least a portion of said core of magnetic material, and a secondary inductor wrapped around at least a portion of said core of magnetic material, said primary inductor and said secondary inductor being arranged in an assembly shaped and sized to fit over a portion of said lamp as a socket, said primary inductor being arranged to be electrically connected to said lamp in a manner such that a variation in the inductance of said primary inductor will cause a corresponding variation in the intensity of light emitted by said lamp while said lamp is electrically connected to said primary inductor, wherein said core of magnetic material, said primary inductor, and said secondary inductor are configured in a manner such that when electrical current is passed through said secondary inductor and said electrical current is varied, the degree of saturation of said core of magnetic material around which said primary and secondary inductors are wrapped is varied, so that the inductance of said primary inductor in turn is varied, causing a change in the intensity of light emitted by said lamp.

4. A light regulation device in accordance with claim 3, wherein said lamp is a discharge lamp.

5. A light regulation device in accordance with claim 4, wherein said lamp is a fluorescent lamp.

6. A light regulation device in accordance with claim 3, wherein said primary inductor and said secondary inductor are wound on a cylindrical bobbin constructed to fit over an end portion of said lamp.

7. A light regulation device in accordance with claim 3, wherein at least a portion of said core of magnetic material is positioned in a manner such as to be located between said primary and secondary inductors and said portion of said lamp surrounded by said primary inductor and said secondary inductor.

8. A light regulation device in accordance with claim 7, wherein there are a plurality of said cores of magnetic material.

9. A light regulation device in accordance with claim 7, wherein said core of magnetic material is configured in a substantially rectangular shape enclosing a region through which said primary inductor and said secondary inductor pass.

10. A light regulation device in accordance with claim 7, wherein said primary inductor and said secondary inductor are wound on a cylindrical bobbin constructed to fit over a portion of said lamp, and said cylindrical bobbin has an indentation to accommodate said core of magnetic material located between said primary and secondary inductors and said portion of said lamp surrounded by said primary inductor and said secondary inductor.

11. A light regulation device in accordance with claim 3, further comprising at least one slip-on terminal configured to slip over a lamp pin of said lamp to provide an electrical connection between said primary inductor and said lamp pin.

12. A light regulation device in accordance with claim 11, further comprising at least one other slip-on terminal providing another electrical connection between said primary inductor and another lamp pin of said lamp.

13. A light regulation device in accordance with claim 12, wherein said at least one other slip-on terminals also provides an electrical connection between said secondary inductor and said other lamp pin.

14. A method of manufacturing a device for regulating the intensity of light emitted by a lamp, comprising the steps of:

providing a bobbin shaped and sized to fit over a portion of said lamp as a socket, said bobbin comprising a core of magnetic material, winding a primary inductor around at least a portion of said bobbin and at least a portion of said core of magnetic material, and winding a secondary inductor around at least a portion of said bobbin and at least a portion of said core of magnetic material, said primary inductor being arranged to be electrically connected to said lamp in a manner such that a variation in the inductance of said primary inductor will cause a corresponding variation in the intensity of light emitted by said lamp while said lamp is electrically connected to said primary inductor, said core of magnetic material, said primary inductor, and said secondary inductor being configured in a manner such that when electrical current is passed through said secondary inductor and said electrical current is varied, the degree of saturation of said core of magnetic material around which said primary and secondary inductors are wrapped is varied, so that the inductance of said primary inductor in turn is varied, causing a change in the intensity of light emitted by said lamp.

* * * * *